US005722339A

United States Patent [19]

Gross

[11] Patent Number: 5,722,339

[45] Date of Patent: Mar. 3, 1998

[54] DRIP CONTROL FITTING

[76] Inventor: Donald Gross, 7240 Standard Dr., Hanover, Md. 21076

[21] Appl. No.: 707,739

[22] Filed: Sep. 4, 1996

[51] Int. Cl.[6] ..... B63B 19/26

[52] U.S. Cl. ..... 114/182; 114/183 R; 114/197

[58] Field of Search ..... 114/182, 183 R, 114/197, 198, 343; 137/312, 360, 377, 381

[56] References Cited

U.S. PATENT DOCUMENTS

| | | | |
|---|---|---|---|
| 1,278,511 | 9/1918 | Schroeder . | |
| 1,663,777 | 3/1928 | Sargent | 114/182 |
| 1,800,556 | 4/1931 | Mead | 114/182 |
| 3,177,014 | 4/1965 | Bergstrom | 285/206 |
| 4,533,331 | 8/1985 | Bland | 114/197 |
| 4,534,307 | 8/1985 | Overs | 114/197 |
| 5,368,065 | 11/1994 | Humpert et al. | 137/377 |
| 5,456,499 | 10/1995 | Sharpe | 285/39 |

FOREIGN PATENT DOCUMENTS

| | | | |
|---|---|---|---|
| 57158 | 11/1933 | Norway | 114/197 |

*Primary Examiner*—Stephen Avila
*Attorney, Agent, or Firm*—Walter C. Farley

[57] ABSTRACT

A drip control marine fitting for passage of liquid through an opening in the hull of a marine vessel has a hollow tube extending through an opening through the hull, a flange attached to the tube and an opening through the flange to allow flow of fluid out of the vessel. The flange has a first surface abutting the outer surface of the hull and a second surface facing away from the outer surface of the hull. The first surface of the flange has a smaller surface area than the second surface of said flange. A diagonal surface interconnects the first and second surfaces, the lower part of the diagonal surface extending outwardly and downwardly from the first surface to the second surface to inhibit flow of liquid from the passage to the outer surface of the hull.

3 Claims, 5 Drawing Sheets

DRIP CONTROL FITTING

FIELD OF THE INVENTION

This invention relates to marine fittings having drip control surfaces to minimize staining and degradation of surfaces of walls through which the fittings pass.

BACKGROUND OF THE INVENTION

A common problem on boats and ships of all sizes and types, both power and sail, is that through-hull fittings which are used above the water line for the purpose of allowing the passage of liquids from inside the hull to outside the hull will drip during the discharge operation and at the conclusion of the discharge operation. Over time, this dripping causes undesirable and unsightly streaks and stains down the outer surface of the hull between the fitting and the water line. If not cared for, this drip effect can promote corrosion.

Fittings which are subject to this effect include bilge pump discharge fittings, air conditioning raw water supply discharge fittings, cockpit drain fittings and sink drain fittings, among others.

SUMMARY OF THE INVENTION

An object of the present invention is to provide a marine fitting having a surface which separates the discharge surface of the fitting from the outer surface of the hull, or other wall, through which the fitting passes, thereby allowing liquid which would otherwise form a drip running down the wall to fall harmlessly into the water.

Briefly described, the invention comprises a drip control marine fitting for liquid passage through an opening in a wall such as the hull of a marine vessel including a generally tubular, hollow portion dimensioned to pass through the opening through the hull. A flange is attached to the tubular portion, the flange having an opening substantially coaxial with the tubular hollow portion to allow flow of liquid therethrough, a first surface adapted to abut an outer surface of the hull and a second surface spaced from and facing away from the outer surface of the hull, the first surface of the flange having a smaller surface area than the second surface of the flange. The fitting is held in the opening with the first surface adjacent the outer surface of the wall. A diagonal surface interconnects the first and second surfaces, a portion of the diagonal surface extending outwardly and downwardly from the first surface to the second surface to inhibit flow of liquid from the opening to the outer surface of the hull.

BRIEF DESCRIPTION OF THE DRAWINGS

In order to impart full understanding of the manner in which these and other objects are attained in accordance with the invention, particularly advantageous embodiments thereof will be described with reference to the following drawings, which form a part of this disclosure, and wherein.

DESCRIPTION OF THE PREFERRED EMBODIMENTS

Figure 2:
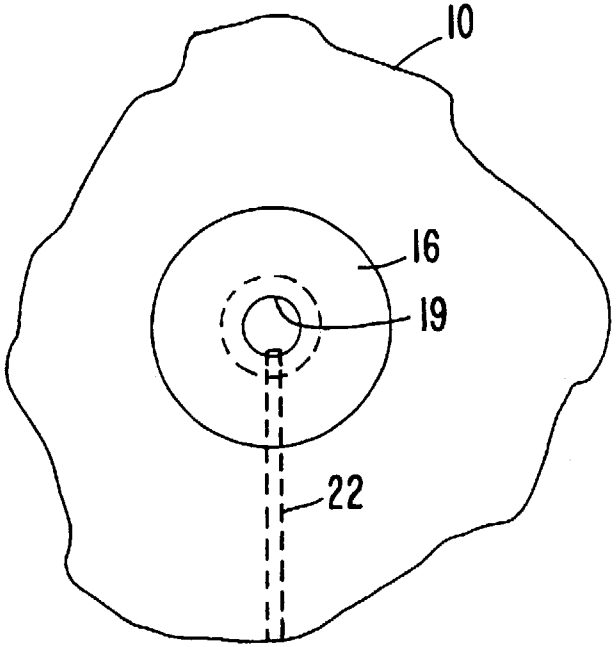
FIG. 2 PRIOR ART
FIG. 2 is an end elevation of the fitting of FIG. 1.
Figure 1:
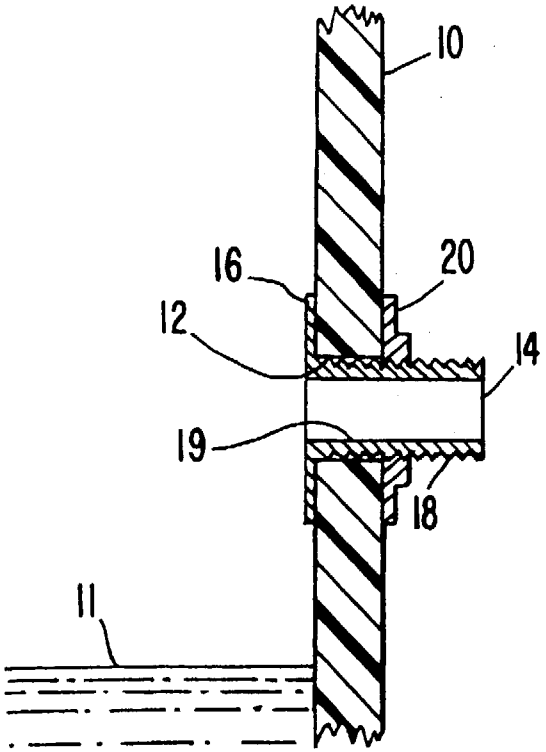
FIG. 1 PRIOR ART
FIG. 1 is a side elevation, in section, of a prior art marine fitting over which the present invention is an improvement.

FIGS. 1 and 2 show a typical installation of a prior art marine discharge fitting in the hull of a marine vessel. The generally vertical hull 10 of the vessel has an opening 12 therethrough above the waterline to receive a fitting 14. Fitting 14 has a flange 16 which abuts the outer surface of hull 10 and an externally threaded tubular portion 18 with a liquid-conducting central passage 19. An internally threaded locknut 20 is threaded onto tubular portion 18 and abuts the inner surface of hull 10, clamping the hull between flange 16 and the locknut to hold the fitting in position. The inner end of fitting 14 can be provided with threads or other coupling means for connection of a conduit or hose in a conventional manner to deliver fluid for discharge overboard through passage 19.

The flange can have various shapes, such as a curved outer surface, and the inner end of the tubular portion, but one characteristic is common. As liquid flows out of the fitting, especially at the end of the flow, some of the liquid inevitably flows down the outer surface of the flange and dribbles down the outer surface of the hull as indicated at 22 in FIG. 2. This dribbling down the side of the vessel causes unsightly streaks over time between the fitting and the waterline of the vessel.

Figure 3:
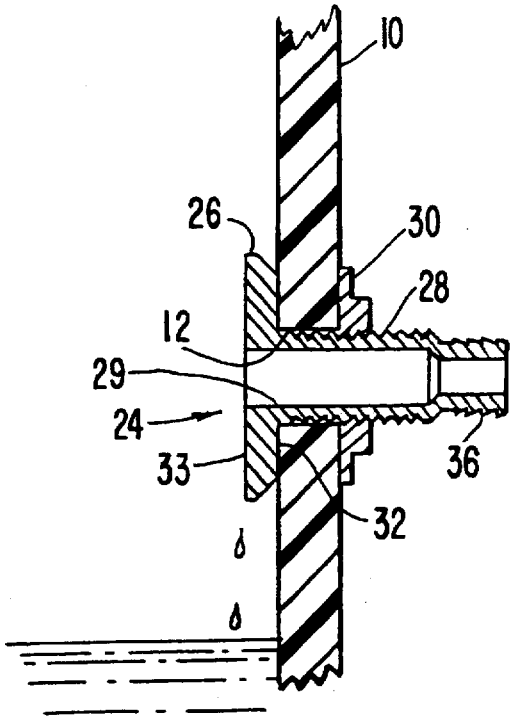
FIG. 3 is a side elevation, in section of a first embodiment of a fitting in accordance with the invention.
Figure 4:
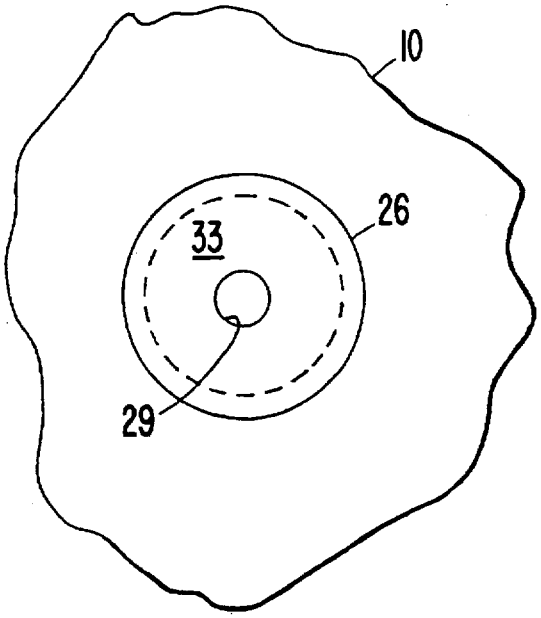
FIG. 4 is an end elevation of the fitting of FIG. 2.

This problem is avoided by a fitting in accordance with the invention, a first embodiment of which is shown in FIGS. 3 and 4. The hull 10 of a vessel has the same kind of opening 12 which receives a fitting indicated generally at 24 in accordance with the invention. Fitting 24 has a tubular externally threaded portion 28 and an outer flange 26 which abuts the outer surface of hull 10. An internally threaded locknut 30 is threaded onto tubular portion 28 and abuts the inner surface of the hull. Tubular portion 28 has a fluid passage through which liquid can pass.

Flange 26 has an inner surface 32 which directly abuts the outer surface of hull 10, and an outer surface 33 which faces away from the hull. Between surfaces 32 and 33 is a beveled or inclined surface 35. Surface 33 is larger than surface 32, so surface 35 extends outwardly and downwardly away from surface 32 and the hull of the vessel.

Any liquid which clings to the fitting during after discharge flows down surface 33 and reaches the periphery of that surface. Since the liquid cannot flow uphill from the rim of surface 33, it falls into the water, but it does not flow down the outer surface of hull 10. Thus, the streaking and staining of the hull is avoided.

As best seen in FIG. 3, the inner end of the fitting can be provided with a straight hose connector 36 of a conventional type.

Figure 5:
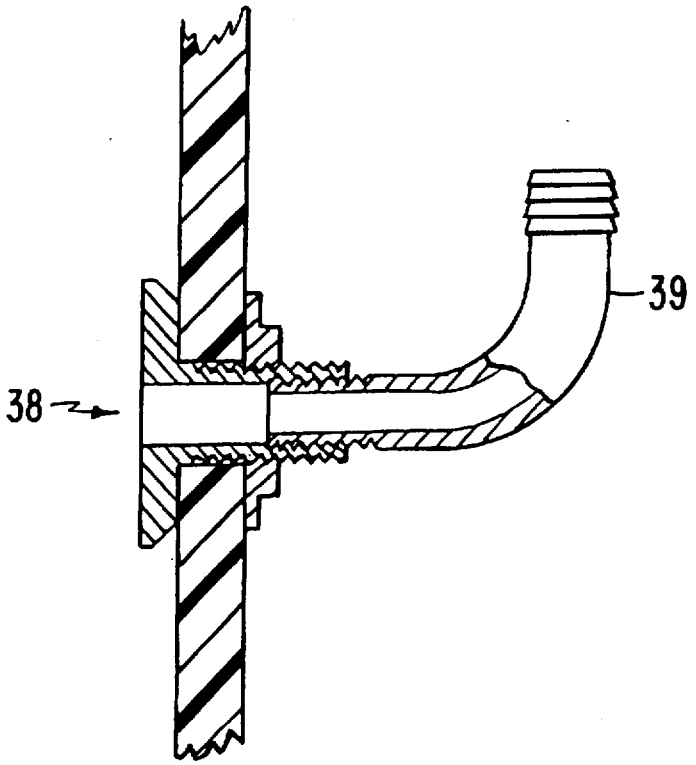
FIG. 5 is a side elevation, in partial section, of a second embodiment of a fitting in accordance with the invention.

In the embodiment of FIG. 5, the inner end of fitting 38 is provided with internal threads to which a curved hose fitting 39 can be connected.

In the embodiment of FIGS. 3 and 4, flange 26 is generally circular, and surface 35 is general conical. However, as will be discussed hereinafter, other shapes can be used.

Figure 7:
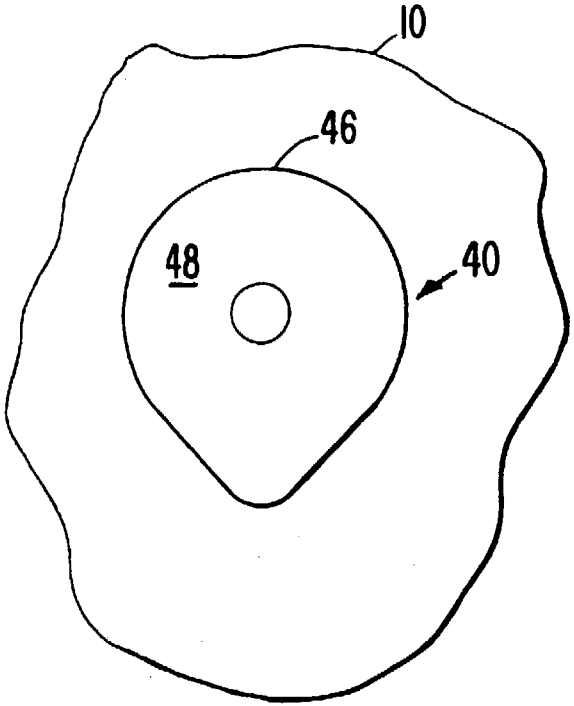
FIG. 7 is an end elevation of the fitting of FIG. 6.
Figure 6:
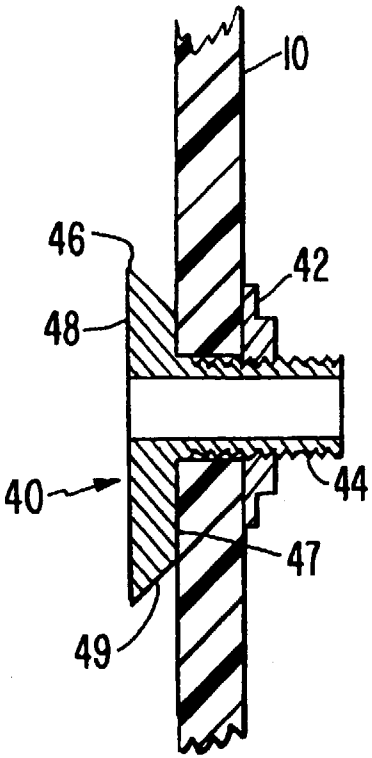
FIG. 6 is a side elevation, in section, of a third embodiment of a fitting in accordance with the invention.

FIGS. 6 and 7 show an embodiment in which the flange is shaped to direct any dripping in a specific way. As shown therein, a fitting 40 extends through a hole in a generally vertical hull 10 and is held therein by a locknut 42. The fitting has an externally threaded tubular portion 44 and a flange 46 with an inner surface 47 abutting the outer surface of hull 10, an outer surface 48 spaced from the hull and a sloping surface 49 extending outwardly from surface 47 to surface 48. As in the previous embodiments, surface 48 is larger than surface 47, but surface 48 is non-circular, having a generally circular upper portion and an elongated, slightly pointed, lower portion.

As in the previous embodiments, any liquid clinging to the fitting is guided by gravity along sloping surface 49 to the lower end of surface 48 from which it drips into the water. Also as in the other embodiments, the inner end of tubular portion 44, inside the hull, can be fitted with hose connections or internal threads for the attachments of other liquid-delivery conduits.

Figure 9:
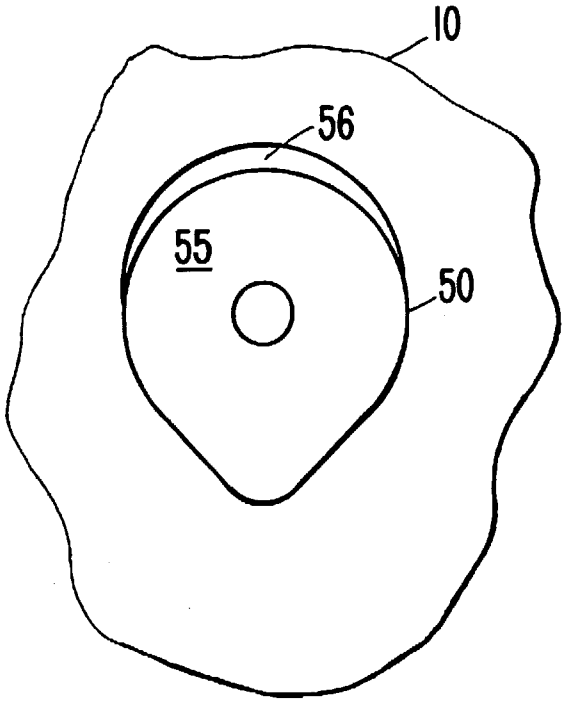
FIG. 9 is an end elevation of the fitting of FIG. 8.
Figure 8:
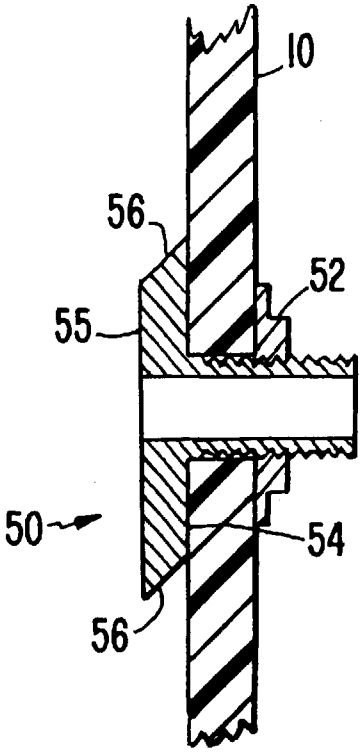
FIG. 8 is a side elevation, in section, of a fourth embodiment of a fitting in accordance with the invention.

FIGS. 8 and 9 show an embodiment in which both the upper and lower surfaces of the fitting slope down and away from the hull. As seen therein the fitting 50 is installed in hull 10 as previously described with a locknut 52. The flange of fitting 50 has an inner surface 54 against the hull and an outer surface 55 spaced from and facing away from the hull. These surfaces of the flange can be of substantially the same size. Between them is a surface 56 which, at the upper and lower ends of the flange, slopes outwardly and downwardly. At the sides of the flange, surface 56 is essentially vertical and curves to smoothly join the inner and outer surfaces.

With this fitting, any liquid flowing down the side of the hull as well as liquid emerging from the fitting opening is guided away from the hull rather than being allowed to trickle down the hull.

Fittings made for marine use are commonly cast and/or machined using bronze or some similarly non-corrosive material, and it is contemplated that the fittings in accordance with the invention can also be made of such materials. However, the fittings, particularly those of the embodiments of FIGS. 6–9, can advantageously be molded using various polymeric materials such as Delrin or the like.

While certain advantageous embodiments have been chosen to illustrate the invention, it will be understood by those skilled in the art that various modifications can be made therein without departing from the scope of the invention as defined in the appended claims.

What is claimed is:

1. A drip control marine fitting for passage through an opening in a wall of a marine vessel comprising a generally tubular, hollow portion dimensioned to pass through an opening through a wall;

a flange attached to said tubular portion, said flange having an opening substantially coaxial with said tubular hollow portion to allow flow of fluid therethrough, a generally circular first surface adapted to abut an outer surface of said wall and a generally circular second surface facing away from said outer surface of said wall, means for holding said fitting in said opening with said first surface adjacent said outer surface of said wall; and a conical diagonal surface interconnecting said first and second surfaces, a portion of said diagonal surface extending outwardly and downwardly from said first surface to said second surface to inhibit flow of liquid from said opening through said flange to said outer surface of said wall.

2. A fitting according to claim 1 wherein said first surface of said flange has a smaller surface area than said second surface of said flange.

3. A drip control marine fitting for passage through an opening in a wall of a marine vessel comprising a generally tubular, hollow portion dimensioned to pass through an opening through a wall;

a flange attached to said tubular portion, said flange having an opening substantially coaxial with said tubular hollow portion to allow flow of fluid therethrough, a generally circular first surface adapted to abut an outer surface of said wall and a non-circular second surface facing away from said outer surface of said wall, means for holding said fitting in said opening with said first surface adjacent said outer surface of said wall; and a diagonal surface interconnecting said first and second surfaces, a portion of said diagonal surface extending outwardly and downwardly from said first surface to said second surface to inhibit flow of liquid from said opening through said flange to said outer surface of said wall.

* * * * *